US005961702A

United States Patent [19]

Doneit

[11] Patent Number: 5,961,702

[45] Date of Patent: Oct. 5, 1999

[54] AIR REPLENISHMENT UNIT

[75] Inventor: Wolfgang Doneit, Bruschal, Germany

[73] Assignee: Gebhardt Ventilatoren GmbH & Co., Waldenburg, Germany

[21] Appl. No.: 09/024,420

[22] Filed: Feb. 17, 1998

[30] Foreign Application Priority Data

Feb. 18, 1997 [DE] Germany ..... 197 06 144

[51] Int. Cl.[6] ..... B01D 46/00

[52] U.S. Cl. ..... 96/381; 55/355; 55/385.2; 55/473; 55/483; 55/502

[58] Field of Search ..... 55/385.2, 365.1, 55/467, 471, 473, 483, 502, 355; 96/381; 454/187

[56] References Cited

U.S. PATENT DOCUMENTS

| | | | |
|---|---|---|---|
| 4,088,463 | 5/1978 | Smith | 55/385.2 |
| 4,344,784 | 8/1982 | Deckas et al. | 55/385.2 |
| 4,560,395 | 12/1985 | Davis | 55/385.2 |
| 4,620,869 | 11/1986 | Goosens et al. | 55/502 |
| 4,790,863 | 12/1988 | Nobiraki et al. | 55/473 |
| 4,846,859 | 7/1989 | Nobiraki et al. | 55/473 |
| 4,917,713 | 4/1990 | Helmus | 55/385.2 |
| 5,053,065 | 10/1991 | Garay et al. | 55/385.2 |
| 5,141,540 | 8/1992 | Helmus | 55/473 |
| 5,279,090 | 1/1994 | Yamaguchi et al. | 55/355 |
| 5,348,563 | 9/1994 | Davis | 55/385.2 |
| 5,470,363 | 11/1995 | Leader et al. | 55/385.2 |
| 5,496,389 | 3/1996 | Wilcox | 55/473 |
| 5,733,348 | 3/1998 | Skarsten | 55/385.2 |

FOREIGN PATENT DOCUMENTS

| | | | |
|---|---|---|---|
| 3719734 | 12/1988 | Germany | 55/385.2 |
| 2-111411 | 4/1990 | Japan | 55/385.2 |

*Primary Examiner*—Duane S. Smith
*Attorney, Agent, or Firm*—Browdy and Neimark

[57] ABSTRACT

An air replenishment unit more particularly for suspension under ceilings of clean rooms, including a housing whose wall is provided with a fan on the intake side, an outlet opening of the housing being functionally connected with an air filter arrangement. The strip-like housing having the fan is bent on the intake side at two opposite sides in an arcuate manner toward the output side, the two longitudinal edges of such wall being joined to two side walls, which are essentially parallel to each other, by folded sheet joints. The free edges, not having any folded joints, of the strip-like wall and the side walls essentially define an outlet opening. Such a housing together with a fan may be produced simply, economically and with a light weight using only three pre-stamped parts using folded or crimped seams and then constitutes a single-piece downwardly open hood-like housing with high class flow properties.

17 Claims, 3 Drawing Sheets

AIR REPLENISHMENT UNIT

BACKGROUND OF THE INVENTION

1. Technical Field of the Invention

The invention relates to an air replenishment unit more particularly for suspension under ceilings of clean rooms, comprising a housing whose wall is provided with a fan on the intake side, an outlet opening of the housing being functionally connected with an air filter arrangement.

2. The Prior Art

Such air replenishment units for clean rooms are for instance disclosed in the European patent publication 0 735 329 A or the German utility model publication 29,503,373. Known air replenishment units or air inlet filters having an upper fan normally possess a multi-part welded box-like housing, to which the filter arrangement is permanently joined, more particularly by welding or screws. Known devices are therefore generally complex and expensive to manufacture and owing to their shape, dimensions and weight are difficult and awkward to mount.

OBJECT AND SUMMARY OF THE INVENTION

One object of the invention is to provide an air replenishment unit which is simpler, less expensive and easier to handle.

In order to achieve these and/or other objects. The strip-like housing of the invention having the fan is bent on the intake side at two opposite sides in an arcuate manner toward the output side, the two longitudinal edges of such wall being joined to two side walls, which are essentially parallel to each other, by means of folded joints and the free edges, not having any folded joints, of the strip-like wall and the side walls essentially define the outlet opening.

The housing, which in the finished condition is a single-piece structure, comprises only three pieces of sheet metal, which are able to be pre-stamped and are able to be joined together by folds in a sealing manner. The manufacture of such a low-weight housing is accordingly simple and economic. Owing to the wall being curved toward the outlet side an advantageous air flow is produced with the smallest possible volume at a minimum resistance to flow, the guidance of the air being aided by the housing, while the optimum acoustic properties are produced in a simple manner. The three housing parts may be joined together without mechanical connecting elements and without welding in a simple manner providing air tightness.

The air-tight fold joints are conveniently in the form of turned-out or elbow seams.

In a simple embodiment of the invention the fan can be an optimized fan module fixed directly or by means of a holding frame in a substantially central opening in the strip-like wall. Such a pre-assembled, adjusted and calibrated fan module can be mass produced with suitable quality control and have its functions checked prior to fitting in position. It is preferred to utilize a radial fan for the air replenishment unit.

The air filter arrangement is preferably designed with at least one sheet-like filter element arranged in a filter frame, the filter frame being provided with a peripherally extending sealing groove or slot facing the housing (for which it acts as a support element), such sealing groove being adapted to sealingly receive the free edges, surrounding the air outlet opening, of the housing or of an intermediate or adapter frame arranged at the outlet opening. In this respect the sealing groove comprises a sealing composition, preferably in the form of a viscous sealing composition (or fluid seal). This means that the housing provided with the fan merely has to be mounted on the filter frame in order to produce a sealing joint. The viscous sealing composition, which may solidify without loss of its elastic properties, additionally serves to keep the housing fixed in position. As a holding means for the filter frame it is more particularly possible to utilize the ceiling rail arrangement of a clean room. In such case a plurality of such air replenishment units are held in a regular grid formation in the arrangement of ceiling rails to at least partially constitute the ceiling of the clean room. In such a case such air replenishment units are mounted on the individual elements of the ceiling rail arrangement only either directly or using am adapter frame.

The fan is preferably provided with an inlet filter on the intake side thereof.

For silencing a muffler arrangement is provided between the fan and the air filter arrangement, such muffler arrangement being more especially designed in the form of a muffler, such as a hood muffler, arranged on the fan. In addition the housing may possess an acoustic insulating or acoustic damping lining.

BRIEF DESCRIPTION OF THE DRAWINGS

Further advantageous developments and convenient forms of the invention will be understood from the following detailed descriptive disclosure of embodiments thereof in conjunction with the accompanying drawings.

DETAILED DESCRIPTION OF THE PREFERRED EMBODIMENT(S) OF THE INVENTION

Figure 1:
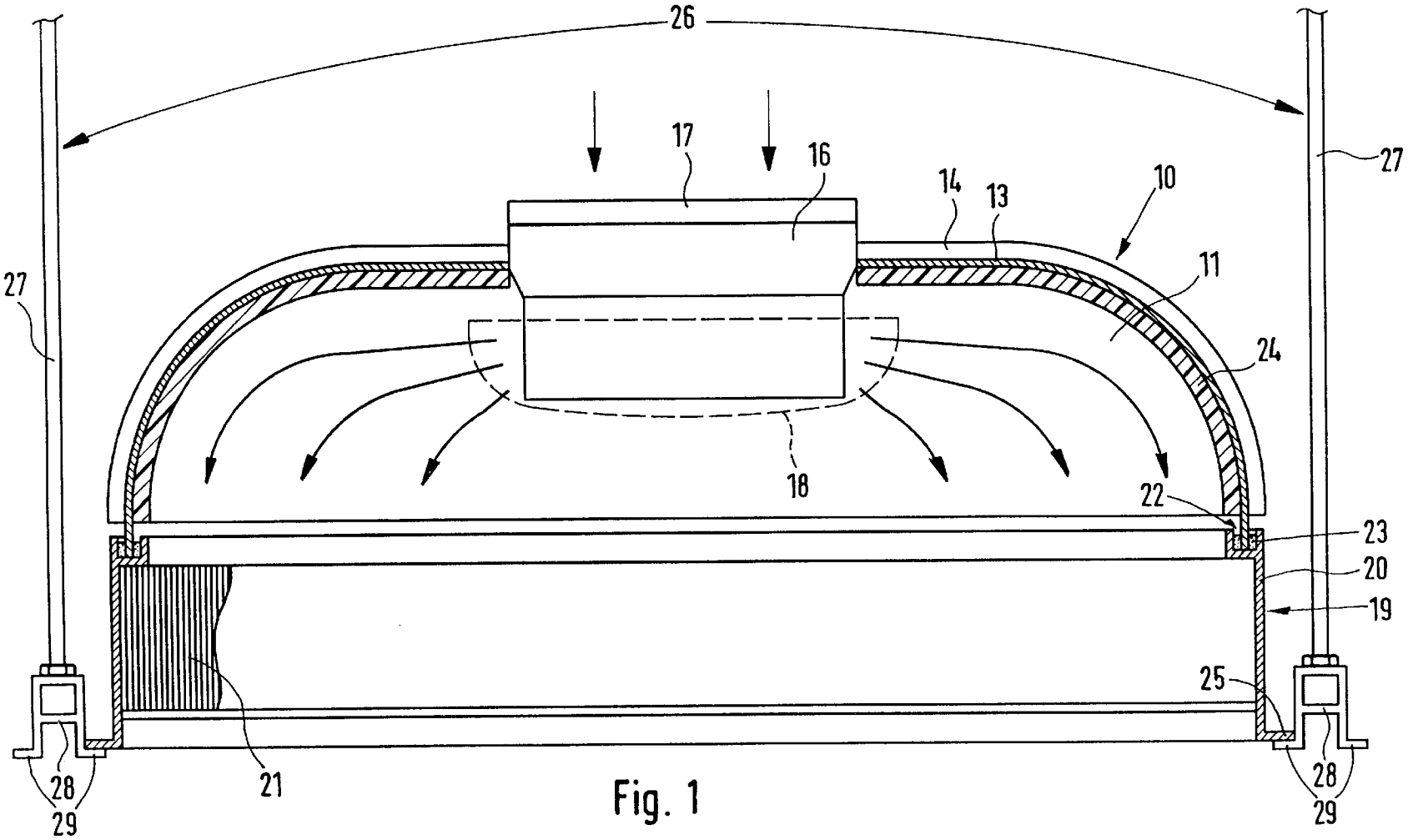
FIG. 1 shows a longitudinal sectional view of an air replenishment unit borne by a ceiling rail arrangement in a clean room as a first embodiment of the invention.
Figure 2:
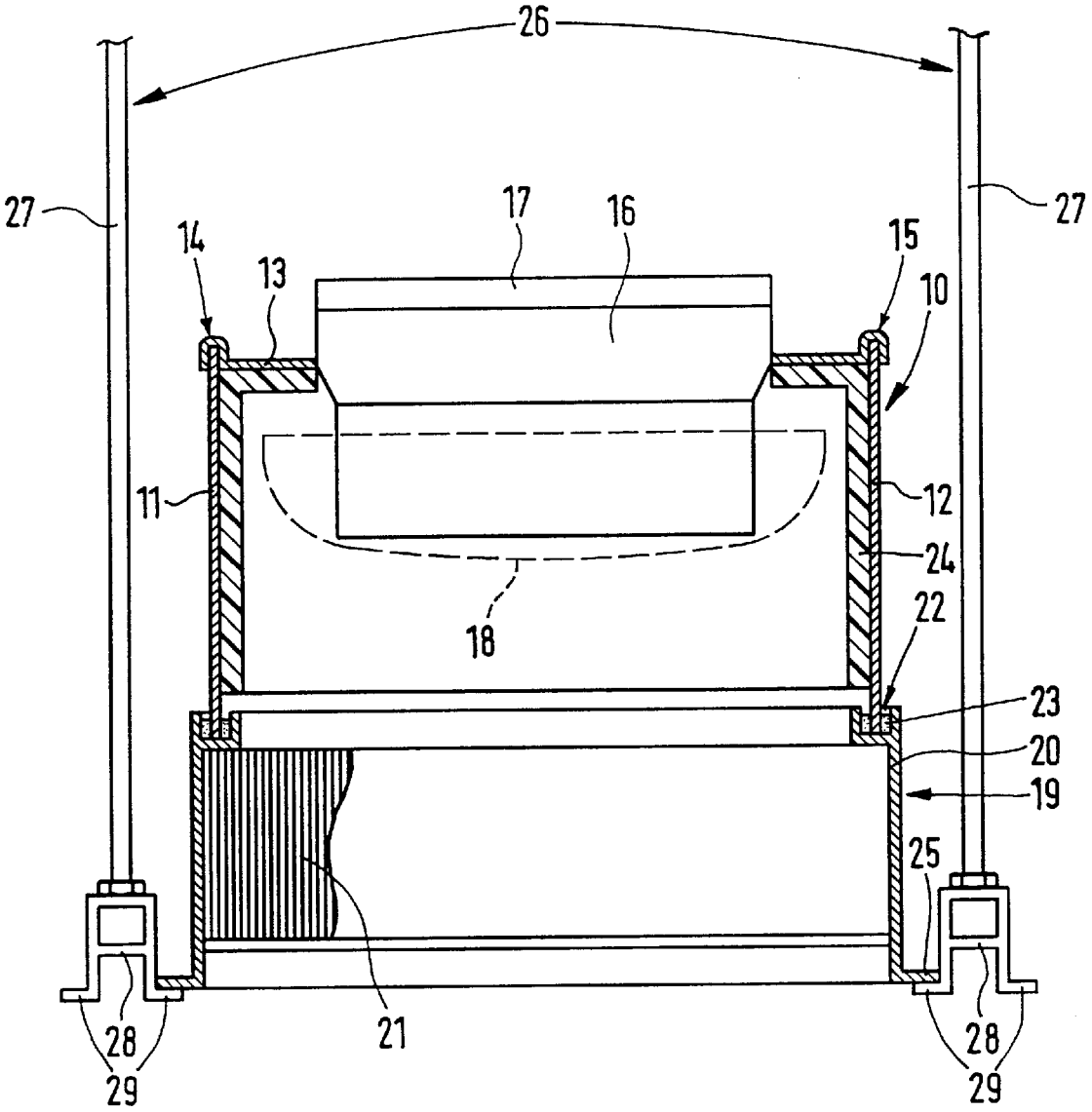
FIG. 2 is a cross sectional view of the same air replenishment unit.

In the case of the embodiment depicted in FIGS. 1 and 2 a housing 10 comprises two vertical and mutually parallel side walls 11 and 12 and an upper strip-like peripheral wall 13. The side walls 11 and 12 possess an essentially semi-elliptical form, the longitudinal side edges extending essentially in parallelism in the central region and the top longitudinal side edge extending at the two end region arcuately toward the bottom longitudinal side edge. The two parallel longitudinal side edges of the strip-like peripheral wall 13 are connected in a sealing manner with the top longitudinal side edges, which are in part arcuate, of the two side walls 11 and 12 by means of a folded or crimped seams 14 and 15, such seams being in the present case in the form of turned-out or elbow seams. This means that a single-piece hood-like housing 10 is formed, which is open in a downward direction, the bottom longitudinal side edges of the side walls 11 and 12 and the two transverse walls of the peripheral wall 13 defining a bottom outlet opening. The top peripheral wall 13 is curved to correspond to the configuration of the side walls 11 and 12. The outlet opening may in this respect—as is illustrated—assume the form of an elongated rectangle, although it may also however be in the form of a square.

The side walls 11 and 12 and the peripheral wall 13 may for example consist of galvanized and/or powder-coated or stainless steel sheet or of aluminum sheet.

Generally in the middle the top peripheral wall 13 a fan 16 is provided in the form of a radial fan. Such fan draws in air from above and blows it through the housing and laterally and radially out again, as is indicated by arrows in FIG. 1. The air current follows the curvature of the peripheral wall 13. The fan 16 is inserted downward into the opening as a pre-assembled, adjusted and calibrated fan module and fixed in place on the peripheral wall 13. It is more especially in a case in which the fan 16 is, and unlike the case of FIG. 1, does not possess any module housing of its own. For attachment of the fan 16 it is also possible to employ a holding frame, as is for example illustrated and described in the said European patent publication 0 735 329 A.

On the intake side the fan 16 is provided with a sheet-like inlet filter 17 and may on the outlet side possess a hood muffler for 18 acoustic damping, such muffler only being illustrated in dash lines. Instead of a hood muffler 18 the fan 10 may also be followed by another muffler, it is however possible to do without the muffler and the inlet filter in simpler designs.

An air filter arrangement possesses a rectangular filter frame 20, in which a sheet-like filter element 21 is held. It is naturally possible to have several individual sheet filter elements to fill out the filter frame 20 instead of a single sheet filter element 21. At its top side the filter frame 20 possesses a sealing groove 22 extending around its edge and containing a viscous sealing composition 23 or fluid seal. During assembly and fitting the housing 10 containing the fan 16 is so mounted on the air filter arrangement 19 that the bottom edges, which define the outlet opening, of the side walls 11 and 12 fit in a sealing manner into such sealing groove 22. The sealing composition 23 may then either remain viscous or it may solidify to constitute an elastic, rubber-like seal. In either case the housing 10 is held on the filter frame 20 as a result. Internally the housing 10 possesses an acoustically damping lining 24. That is to say a sound damping material is applied to the inner sides of the side walls 11 and 12 and of the peripheral wall 13. In this respect it is to be ensured that such lining 24 does not extend quite as far as the bottom edges so that same may still be inserted in the sealing groove 22.

At its bottom edge the filter frame 20 possesses a laterally projecting flange-like support ledge 25. On assembly a plurality of such air filter arrangements 19 are mounted using their flange-like rims 25, see FIGS. 1 and 2, in a ceiling rail arrangement 26 under the ceiling of a clean room. Such ceiling rail arrangement comprises a multiplicity of holding rods 27 secured to the ceiling, and arranged in a regular grid. At respective bottom ends thereof same bear holding elements 28 having laterally projecting support elements 29, on which the air filter arrangements 19 are borne with the aid of their support ledge 25. Same may be omitted as well, if the filter frames 20 are able to be mounted directly on the support elements 29. The air filter arrangements 19 thus positioned in one plane constitute a ventilating ceiling of a clean or other room.

Figure 3:
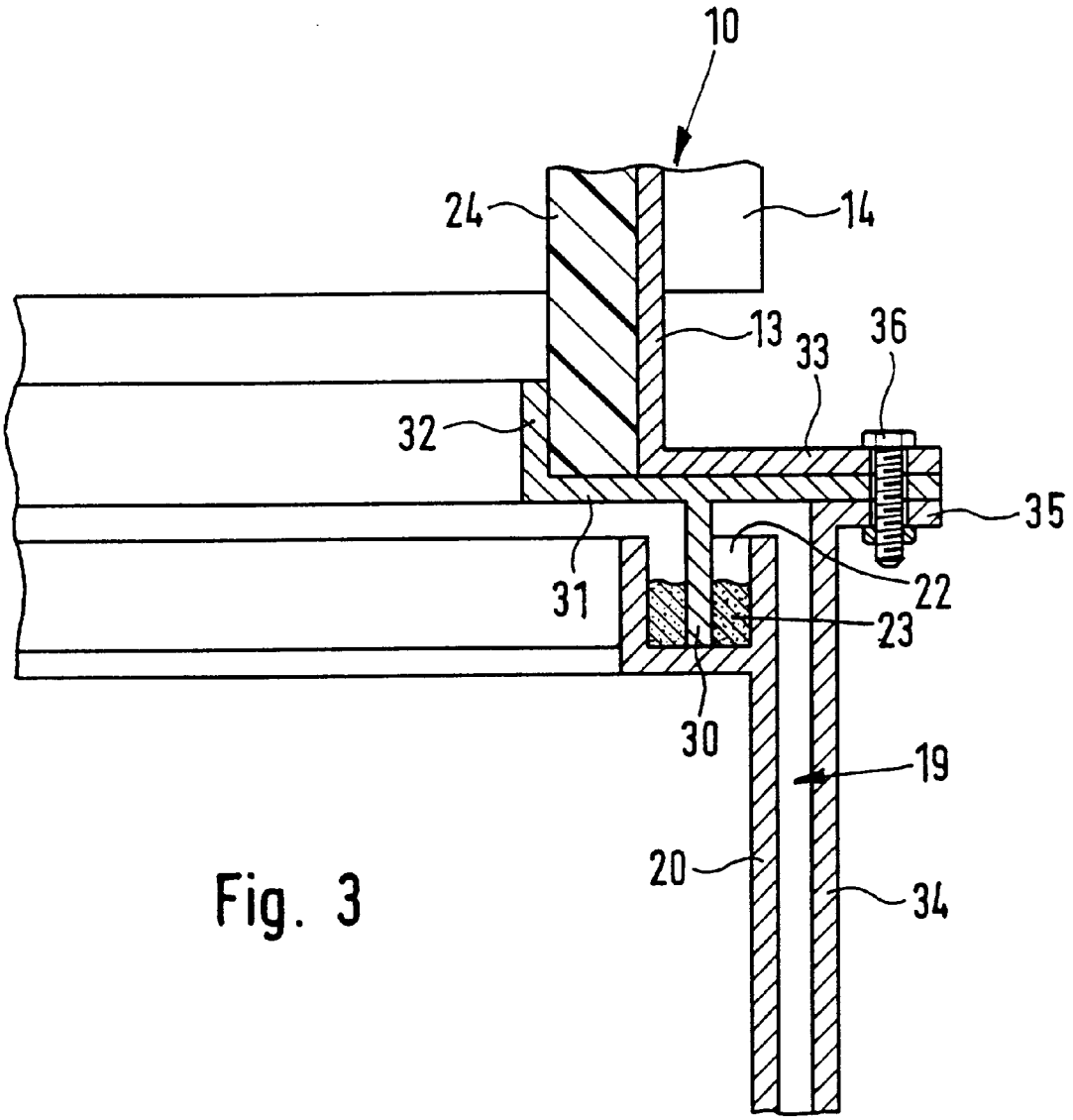
FIG. 3 shows an intermediate frame for connection of the housing bearing the fan with the filter frame as an alternative embodiment.

FIG. 3 represents a detailed view of a modified connection between the housing 10 and the air filter arrangement 19. A rail-like outwardly extending encircling ledge 30 on an adapter frame 31 extends in this case into a sealing groove 22, filled with sealing composition, in the filter frame 20. At bottom edges defining the outlet opening, the wall 13 of the housing 10 (and also the walls 11 and 12) possess a projection 33, which extends outwardly at an angle, enabling the wall to be supported in a sealing manner on the adapter frame 31, for which purpose a flat gasket, not illustrated, may be intermediately placed. At its inner end this adapter frame 31 possesses an encircling, rail-like support ledge 32, against which the internal lining 24 of the housing 10 rests. A vertical holding wall 34 surrounds the filter frame 20 and at its top end possesses a region 35 which is bent in an outward direction, against which the adapter frame 31 bears. This holding wall 34 has its bottom end edge resting on the holding elements 28 and, respectively, the support elements 29, the support projections 25 of the filter frame 30 being omitted. Accordingly the air filter arrangement 19 is suspended on the adapter frame 31, a solid sealing composition 23 and/or an additional holding means such as fastening screws or the like being provided for attachment.

The holding wall 34 may naturally, if required, also possess a support ledge corresponding to the support ledge 25. The region 35, set at an angle, of the holding wall 34, the adapter frame 31 and the rail-like projection 33 on the peripheral wall 13 (or, respectively, of the side walls 11 and 12) are held together by means of holding screws 36. Same may be omitted if seals or bonds are provided between the portions which are held together in order to prevent slipping.

The adapter frame 31 renders possible on the one hand compensation of differences in dimensions of the housing 10 and of the filter frames 20 and on the other hand serves as a holding member for the housing 10 and as a holder for the air filter arrangement 19. Furthermore a relatively thick lining 24 may extend as far as the bottom limiting edge of the housing 10.

It is naturally also possible, if required, to provide adapter frames between the filter frame 20 and the ceiling rail arrangement, if it is necessary to compensate for differences in dimensions. If necessary it is possible to provide respective additional screw or bonded joints.

I claim:

1. An air replenishment unit for suspension under ceilings of clean rooms, comprising a housing having a strip shaped wall provided with a fan on the intake side, an outlet opening of the housing being functionally connected with an air filter arrangement, wherein the strip shaped wall having the fan is bent on the intake side at two opposite sides in an arcuate manner toward the output side, two longitudinal edges of the strip shaped wall being respectively joined to two parallel sides walls of the housing by means of folded joints and free edges of the strip shaped wall and the side walls essentially defining the outlet opening of the housing.

2. The air replenishment unit as set forth in claim 1, wherein said folded joints are air-tight folded sheet seams.

3. The air replenishment unit as set forth in claim 2, wherein said folded seams are in the form of a turned out elbow seam or other form of seams.

4. The air replenishment unit as set forth in claim 1, wherein said fan is secured in an essentially central opening in the strip shaped wall either directly or by means of a holding frame.

5. The air replenishment unit as set forth in claim 1, wherein said fan is in the form of a radial fan.

6. The air replenishment unit as set forth in claim 1, wherein the fan is designed in the form of a pre-assembled sub-module.

7. The air replenishment unit as set forth in claim 1, wherein said air filter arrangement comprises at least one sheet filter element arranged in a filter frame.

8. The air replenishment unit as set forth in claim 1, wherein said filter frame is provided on the housing side with at least one sealing groove extending around an edge, such sealing groove being adapted to sealingly receive the free edges, surrounding the air outlet opening, of the housing or of an intermediate or adapter frame arranged at the outlet opening.

9. The air replenishment unit as set forth in claim 8, wherein said sealing groove contains a sealing composition.

10. The air replenishment unit as set forth in claim 9, wherein said composition is in the form of a viscous sealing composition as a fluid seal.

11. The air replenishment unit as set forth in claim 1, wherein the housing is mounted on an air filter arrangement held on a holding device.

12. The air replenishment unit as set forth in claim 1, wherein said housing is mounted on an adapter frame held on a holding frame, the air filter arrangement being suspended underneath on the adapter frame or on the housing.

13. The air replenishment unit as set forth in claim 11, wherein said holding device is constituted by the ceiling rail arrangement of a clean room.

14. The air replenishment unit as set forth in claim 13, wherein said unit is one of a plurality of like ceiling rail-mounted air replenishment units, with which said unit at least partly occupies the extent of a ceiling.

15. The air replenishment unit as set forth in claim 1, wherein the fan is provided on an intake side thereof with an, intake filter.

16. The air replenishment unit as set forth in claim 1, comprising a muffler arrangement located between the said fan and the air filter arrangement, such muffler being an acoustic muffler engaged on the fan.

17. The air replenishment unit as set forth in claim 1, wherein said housing possesses an acoustically insulating or acoustically muffling lining.

* * * * *